United States Patent [19]

Cooke

[11] Patent Number: 4,578,932

[45] Date of Patent: Apr. 1, 1986

[54] APPARATUS FOR FORMING A BAND AROUND A STACK OF SHEETS

[75] Inventor: Richard H. Cooke, West Worthing, England

[73] Assignee: De La Rue Systems Limited, London, England

[21] Appl. No.: 589,252

[22] Filed: Mar. 13, 1984

[51] Int. Cl.[4] ..... B65B 13/04

[52] U.S. Cl. ..... 53/587; 53/211

[58] Field of Search ..... 53/587, 214, 211

[56] References Cited

U.S. PATENT DOCUMENTS

| | | | |
|---|---|---|---|
| 2,914,897 | 12/1959 | Haugwitz | 53/587 X |
| 3,955,340 | 5/1976 | Tomita et al. | 53/587 |
| 4,155,213 | 5/1979 | Blanton et al. | 53/587 |

FOREIGN PATENT DOCUMENTS

| | | | |
|---|---|---|---|
| 2049607 | 12/1980 | United Kingdom | 53/587 |

*Primary Examiner*—James F. Coan

*Attorney, Agent, or Firm*—Cushman, Darby & Cushman

[57] ABSTRACT

Apparatus for feeding banding tape (22) from a tape spool mounted in a tray (27) to a station where a stack is wrapped by the tape, comprises a tape feeder (30) including a feed head (29) terminating in a tape guide (32, 33) which is movable between a first position (30) spaced from the stack and a second position (30') in which the tape guide is adjacent the stack. The tape path length from tape pinch means (28, upstream of the feed head) to the stack is longer for the first feed head position than for the second feed head position (30'). The tape end is clamped next to the stack with the tape feed head in its second position; the feed head is then withdrawn to its first position prior to rotation of the stack to form the band. A tape cutter then cuts the tape downstream of the feed head, and the feed head is thereafter moved to its second position, the tape being pulled back through the feed head until the cut end is flush with the end of the tape guide against the stack.

4 Claims, 8 Drawing Figures

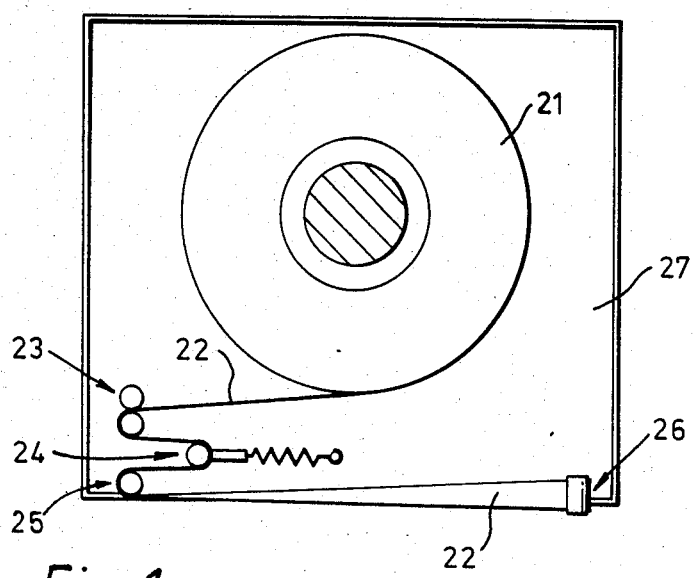
Fig. 1.
Fig. 2.
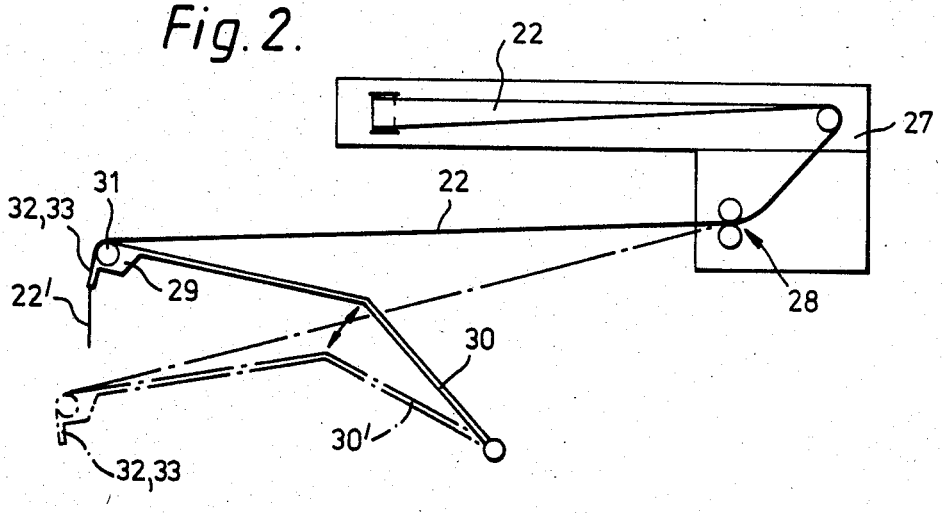

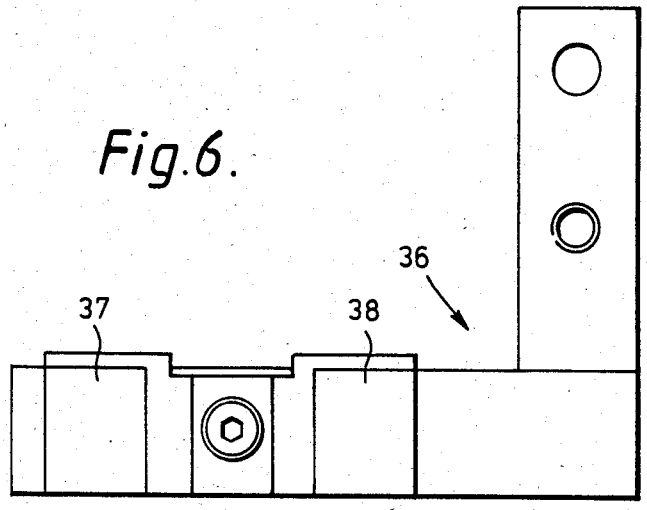
Fig.6.
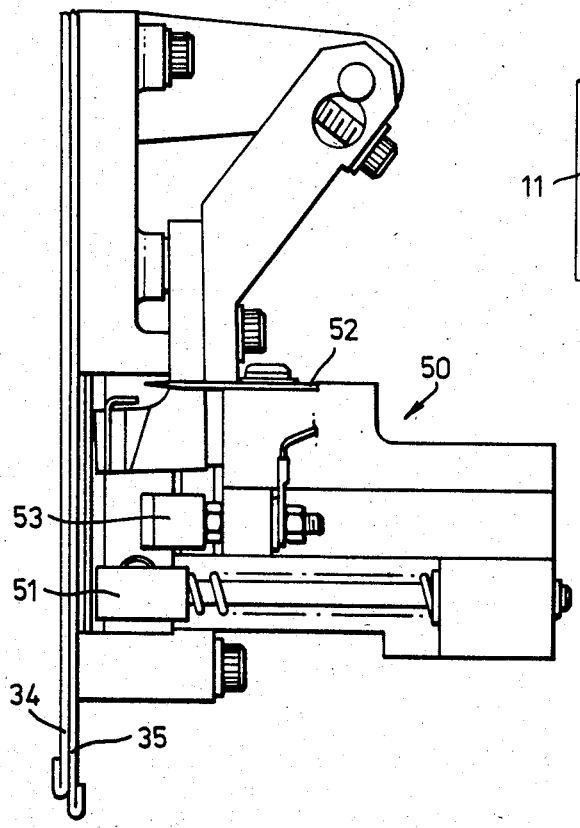
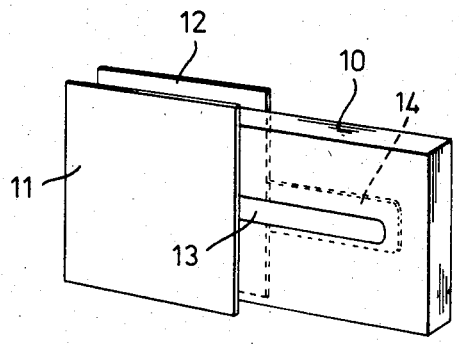
Fig.8.
Fig.7.

APPARATUS FOR FORMING A BAND AROUND A STACK OF SHEETS

In some banding apparatus for forming and sealing a band around stacks of sheets, a stack of sheets is moved across the path of a tape which is to form the band, so that the tape band extends across one face and over two edge faces of the stack. A push member then pushes the tape across the other face of the stack and overlapping portions of the tape are sealed. One example of such apparatus is described in British specification No. 2077655; in this example, the tape extends from a supply spool to a take-up spool on which waste material is wound and a cut is made through the seal, so that the continuity of the strip between the supply and take-up spools is maintained.

In another form of banding apparatus, a free end of tape is fed to the stack and the stack is then rotated to pull the tape from a supply spool and to wind it around the stack, overlapping portions being then sealed. The present invention is concerned with the latter type of banding apparatus. In such apparatus, there is a problem in supplying the free end of the tape to the correct position adjacent the stack and maintaining the free end in this position during rotation. In one such apparatus, described in British specification No. 1464987, a separator finger enters between sheets of the stack and the leading end of the tape, which has an adhesive coating on one surface, is inserted between the sheets in a folded condition.

The present invention makes it unnecessary to insert a separator finger between sheets and thereby obviates the possibility of damage to the sheet edges. It is also more economical in tape use, in that substantially the only tape used is that which forms a band around the stack of sheets and the sealed portions at the end of this band.

Banding apparatus according to the present invention comprises: stack clamping means between which a stack for banding is held; a tape feeder for advancing the free end of a tape to the stack; means for rotating the stack-clamping means with the clamped stack and the tape end to form a band of tape around the stack; tape sealing means for sealing the two tape portions at the ends of the band around the stack; a cutter for cutting the sealed band from the remainder of the tape; and in this apparatus the tape feeder includes a feed head terminating in a tape guide which is narrower than the tape, the feed head being movable between a first position spaced from the stack and a second position in which the tape guide is adjacent the stack, and tape pinch means upstream of the feed head, the path length from the tape pinch means to the stack being longer for the first feed head position than for the second feed head position; the apparatus further comprising tape clamping means operable when the tape end is in its second position to clamp the tape against the stack alongside the tape guide, allowing withdrawal of the feed head to its first position, prior to rotation of the stack to form the band by pulling tape through the pinch means; and the cutter being so positioned that when, with the feed head in its first position, the cutter has cut the tape downstream of the feed head, and the feed head is thereafter moved to its second position, the tape is pulled back through the feed head until the cut end is substantially flush with the end of the tape guide against the stack.

In the preferred form of the invention, to take up variations in acceleration as the tape is drawn from a supply spool, the apparatus includes a spring buffer roller in the part of the tape between the tape supply spool and pinch rollers.

In order that the invention may be better understood, a preferred embodiment of the invention will now be described with reference to the accompanying drawings, wherein:

FIG. 1 is a plan view of a tape feed tray;

FIG. 2 is a side elevation of the tape feed tray with the remainder of the tape feeding apparatus for conveying the tape to the banknote banding station;

FIG. 6 illustrates the clamping means;

FIG. 7 shows the tape clamping means in their clamping position with the sealing means about to move into operative position; and FIG. 8 is a perspective view showing how the platens and clamping fingers hold the stack of notes in position for the banding operations.

Figure 3:
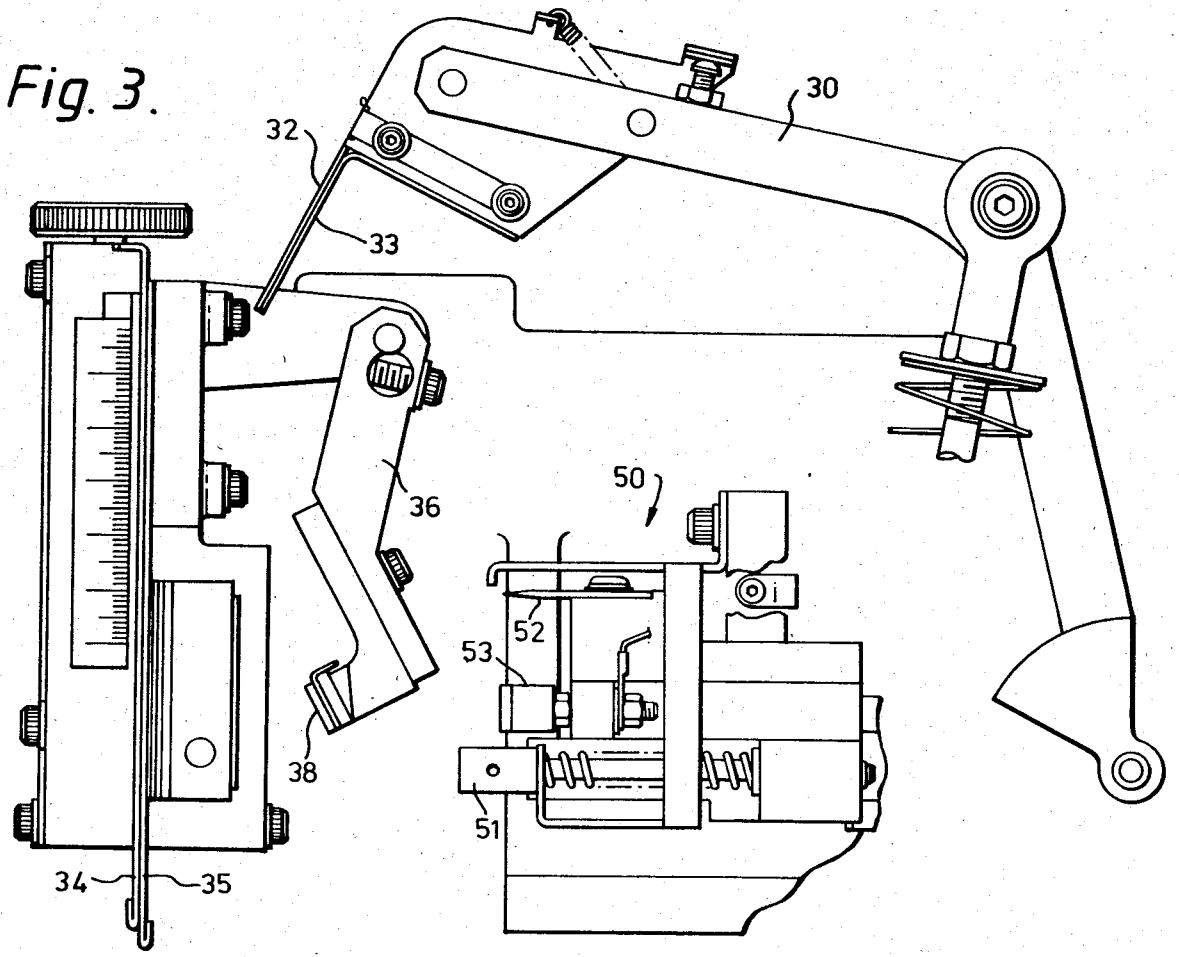
FIG. 3 shows a tape feeder head and the clamping, sealing and cutting means at the banding station.

Referring first to FIG. 8, a stack of notes 10 is placed between platens 11 and 12 and fingers 13 and 14 extend from the platens 11 and 12 to provide additional support for the notes during the banding operation. The finger 14 is somewhat wider than the finger 13 to facilitate heat sealing of the tape, as will be described.

The platens 11 and 12 are mounted for rotation about a longitudinal axis passing between the fingers 13 and 14 to cause a length of tape to be wound around the stack of notes, and around the retractable fingers 13 and 14.

Figure 4:
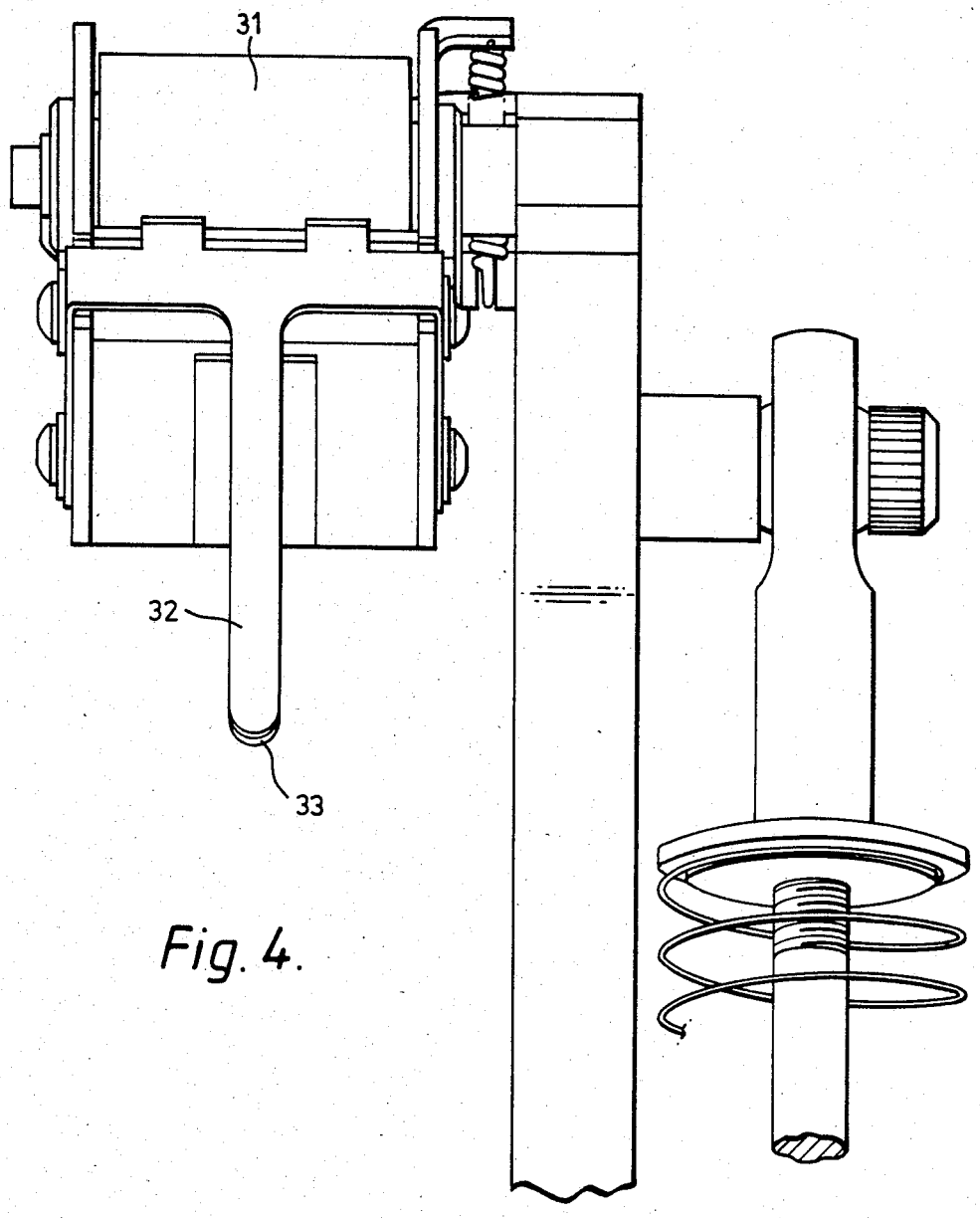
FIG. 4 is an end elevation of the feeder head and tape guide terminating the tape feeder.

Referring now to FIGS. 1 and 2, a tape spool 21 is mounted on a support for clockwise rotation, the support including means for damping the rotational motion of the spool to prevent its sudden acceleration and to maintain tape tension. From the supply spool 21, the tape 22 is threaded between a pair of rollers 23, over a spring-mounted buffer roller 24 and around rollers 25 and 26, the tape undergoing a twist through 90° between rollers 25 and 26. As shown in FIG. 2, on emerging from the tape feed tray 27, the tape passes through pinch rollers 28, from which it extends to the feeder head 29 of pivoted tape feeder arm 30. As shown in FIGS. 3 and 4, the feeder head comprises a roller 31 and overlapping elongate carriers 32 and 33. The width of the tape carriers 32 and 33 is small in relation to the width of the tape. The arm 30 is pivotable between a first position 30' shown in dotted lines, in which the tape guide 22 is adjacent a stack of notes to banded, and a second position, shown in full lines, the arm 30 being in the second and upper position at the end of a banding cycle. At such time, the tape 22 has been cut and has a free end 22' hanging from the guide 32, 33. Because the tape path length from the pinch rollers 28 to exit of the guide 32, 33 is longer for the lower dotted position of the arm than for the upper full line position of the arm, when the arm 30 is pivoted to its lower position the tape end 22' is pulled back through the feed head until its end is substantially flush with the end of the guides 32, 33.

In FIG. 3, the arm 30 is shown in its upper position. The tape and the stack of notes to banded are omitted for clarity. At the beginning of the operation, platens 34 and 35 open to admit a stack of notes which, as shown in FIG. 8, are held at one end only. Note-clamping fingers 13 and 14 (FIG. 8) prevent the other ends of the notes from springing apart.

Figure 5:
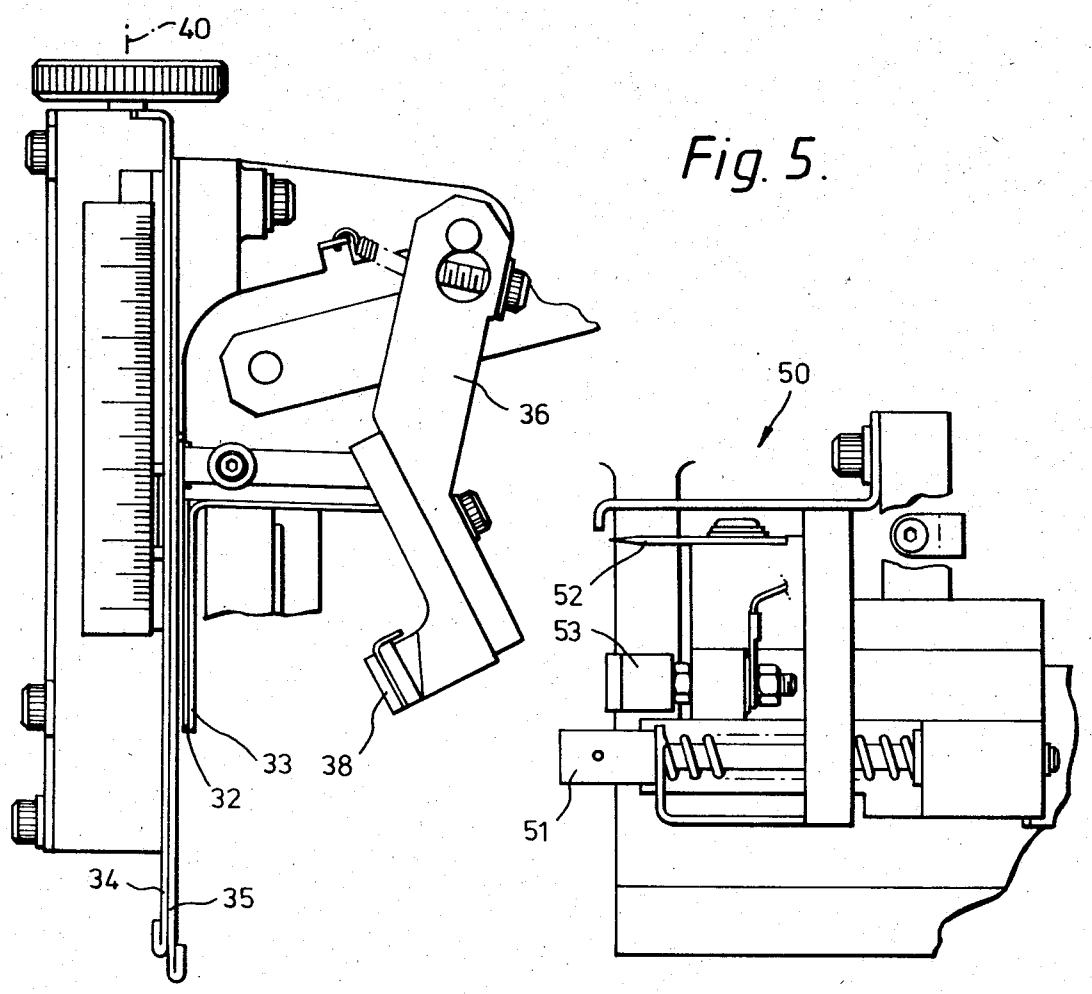
FIG. 5 shows the feeder head in its position with the tape guide at the banding station.

In the first part of the operation, the arm 30 pivots downwards to the position shown in FIG. 5, in which some other parts of the apparatus have been omitted for clarity. The end of the tape now lies against one side of the stack of notes and its central longitudinal strip is held between the narrow guides 32 and 33.

In the next part of the operation, a pivoted tape clamp 36 swings clockwise (FIG. 5) to bring two clamping pads 37 and 38 (FIG. 6) into contact with the tape on each side of the guides 32 and 33. Next, the arm 30 is pivoted to its upper position, thereby increasing the path length from the pinch rollers to the clamps 37 and 38. As a consequence, more tape is pulled through the pinch rollers 28.

The stack-clamping means, with the tape clamping means, is then rotated about an axis 40 the stack, over the fingers 13 and 14. At the end of the rotation, the tape also overlies the back of the clamping pads 37 and 38.

There are now overlapping tape portions below the tape-clamp pads and these are sealed together and the tape is cut by means of a sealer-cutter assembly 50. With the clamping pads 37 and 38 still in their clamping position, the assembly 50 is moved to the left (FIG. 5) to the position shown in FIG. 7. In this position, a spring-loaded clamp 51 is brought into contact with the tape, which is still tensioned by the frictional pinch at the pinch rollers 28, the damper mechanism at the tape spool support, and the spring-loaded buffer roller 24. Further movement of the assembly 50 to the left causes a blade 52 to cut the tape, leaving a free end above the sprung clamp 51. The blade 52 and a heater 53 are advanced together and shortly after the tape has been cut, the heater 53 meets the overlapping ends of the tape and pushes them against the finger 14 (FIG. 8) which is given a greater width than finger 13 for this purpose. A heater element in the heater 53 is then energised with a pulse of electric current to seal together the overlapping ends of the thermoplastic tape. The tape cools very rapidly and the heater/cutter assembly 50 is retracted.

Thereafter, the fingers 13 and 14 are retracted, the platens 12 and 13 are separated, and the bound stack of notes 10 falls into a chute. The apparatus is then ready for the next cycle.

It will be seen that the guides 32 and 33 are in their upper position when the cutter cuts the tape across the whole of its width, but because of the longer tape path length between the pinch rollers and the banding station for the lower position of the pivoted arm 30, when the arm 30 moves to its lower position again the cut end of the tape is pulled back to be substantially flush with the ends of the guides 32, 33. Thus, in each banding operation the cut end is in the same position overlying a side of the stack of sheets and can be clamped in this position because the clamping pads engaged the tape on either side of the guides 32, 33, which are then withdrawn.

As a consequence of this method of positioning the tape end prior to the rotation of the note stack, the wastage of tape beyond the point of sealing is reduced to a very small amount, namely a small tag which can be used for handling the bound stack.

The heat-sealing and cutting assembly are more fully described and are claimed in our copending application No. 8215755.

The pattern of the heater element is preferably such that the overlapping tape ends are sealed along a number of lines parallel to each other and to the length of the tape.

I claim:

1. Banding apparatus comprising:

stack clamping means between which a stack of sheets for banding is held:

a tape-feeder for advancing the free end of a tape to the stack;

means for rotating the stack-clamping means with the clamped stack and the tape end to form a band of tape around the stack;

tape-sealing means for sealing the two tape portions at the ends of the band around the stack;

a cutter for cutting the band around the stack from the remainder of the tape; and in which the tape feeder includes a feed head terminating in a tape guide which is narrower than the tape, said guide extending centrally along a tape passing through said tapefeeder, the feed head being movable between a first position spaced from the stack and a second position in which the tape guide is adjacent the stack, and tape pinch means upstream of the feed head, the path length from the tape pinch means to the stack being longer for the first feed head position than for the second feed head position;

the apparatus further comprising tape clamping means operable when said feed head is in its second position to clamp the tape against the stack alongside the tape guide, allowing withdrawal of the feed head to its first position, prior to rotation of the stack to form the band by pulling tape through the pinch means, said clamping means comprising a pair of clamping pads which, in their clamping position, meet the tape on opposite sides of said guide;

and the cutter being so positioned that when, with the feed head in its first position, the cutter has cut the tape downstream of the feed head, and the feed head is thereafter moved to its second position, the tape is pulled back through the feed head until the cut end is substantially flush with the end of the tape guide against the stack.

2. Banding apparatus comprising:

stack clamping means between which a stack of sheets for banding is held:

a tape-feeder for advancing the free end of a tape to the stack;

means for rotating the stack-clamping means with the clamped stack and the tape end to form a band of tape around the stack;

tape-sealing means for sealing the two tape portions at the ends of the band around the stack;

a cutter for cutting the band around the stack from the remainder of the tape; and in which the tape feeder includes tape pinch means, a tape feed head through which the tape can slide and terminating in a tape guide which is narrower than the tape, the feed head being downstream of the tape pinch means and movable between a first position spaced from the stack and a second position in which the tape guide is adjacent the stack but further from the tape pinch means, the tape path length from the tape pinch means to the stack being longer for the first feed head position than for the second feed head position;

the apparatus further comprising tape clamping means operable when the feed head is in its second position to clamp the tape against the stack alongside the tape guide, allowing withdrawal of the feed head to its first position, prior to rotation of the stack to form the band by pulling tape through the pinch means;

and the cutter being so positioned that when, with the feed head in its first position, the cutter has cut the tape downstream of the feed head, and the feed head is thereafter moved to its second position, the tape is pulled back through the feed head until the cut end is substantially flush with the end of the tape guide against the stack.

3. Banding apparatus in accordance with claim 1, in which the tape feeder is supplied with tape from a supply spool by way of a spring-loaded tensioning roller and a pair of pinch rollers constituting the tape-pinch means.

4. Banding apparatus in accordance with claim 1, in which the tape-sealing means comprises an electric heater having a resistive heating element which seals the overlapping ends of the tape along the number of lines parallel to each other and to the tape length.

* * * * *